US007484979B2

(12) United States Patent
Warton et al.

(10) Patent No.: US 7,484,979 B2
(45) Date of Patent: Feb. 3, 2009

(54) HUB ASSEMBLY

(75) Inventors: Thomas Warton, Sonoma, CA (US); Scott S. Yu, San Francisco, CA (US)

(73) Assignee: Vode Lighting Inc., Sonoma, CA (US)

( * ) Notice: Subject to any disclaimer, the term of this patent is extended or adjusted under 35 U.S.C. 154(b) by 0 days.

(21) Appl. No.: 11/890,062

(22) Filed: Aug. 3, 2007

(65) Prior Publication Data

US 2008/0030980 A1 Feb. 7, 2008

Related U.S. Application Data

(60) Provisional application No. 60/835,663, filed on Aug. 4, 2006.

(51) Int. Cl.
*H01R 33/02* (2006.01)

(52) U.S. Cl. ..... 439/226; 362/217

(58) Field of Classification Search ..... 439/226, 439/242; 362/217, 219

See application file for complete search history.

(56) References Cited

U.S. PATENT DOCUMENTS 5,904,415 A * 5/1999 Robertson et al. ..... 362/260
6,851,829 B2 * 2/2005 Wu ..... 362/217
6,890,199 B2 * 5/2005 Vogt et al. ..... 439/238
2006/0194463 A1 * 8/2006 Lin ..... 439/242

OTHER PUBLICATIONS

U.S. Appl. No. 11/890,061, Warton et al.
U.S. Appl. No. 11/890,065, Warton et al.
U.S. Appl. No. 29/289,743, Yu, S.
U.S. Appl. No. 29/289,744, Yu, S.
U.S. Appl. No. 29/289,761, Yu, S.
U.S. Appl. No. 29/289,868, Yu, S.

* cited by examiner

*Primary Examiner*—Tho D Ta
(74) *Attorney, Agent, or Firm*—Peter Tormey

(57) ABSTRACT

A luminaire having a hub assembly comprising the following: a socket for holding a lamp, a socket holder fixedly coupled to the socket, said socket holder having a hollow raised threaded portion extending away from the socket; a housing for enclosing the socket and the socket holder, said housing having a through a first opening for allowing the threaded portion to extend into the housing and at least one second opening to allow for one or more electrical wires connected to the socket; a spring washer and a nut; a pin slidably affixed to the socket holder; at least one extended member; and at least one hollow support member providing for the extended members to fit inside the support member, wherein the socket holder is rotatably coupled to the housing such that the socket holder is adjustable relative to the housing.

14 Claims, 3 Drawing Sheets

HUB ASSEMBLY

This application claims the benefit of U.S. Patent Application 60/835,663 "Modular lighting system" filed on Aug. 4, 2006 which is incorporated herein by reference.

BACKGROUND

The present disclosure relates to lighting fixtures, and more particularly to a modular lighting system which comprises a plurality of lighting system components which can be presented in a plurality of housings, and even more particular to a hub assembly for mounting a luminaire.

Lighting fixtures are one of the basic lighting devices used in homes, offices and a variety of industrial settings. For example, a typical lighting fixture may be mounted on a wall, at a position above a desk, in a corridor, a door entrance, or a garage door such that the area can be illuminated by the lighting fixture. There are many criteria for luminaire design. This includes cost, aesthetics, functionality, ease of use, ease of installation, safety and energy efficiency among others. One task lighting designers have is finding flexible illumination to provide the visual and illumination effects according to an architectural design. Manufacturers want to provide a wide variety of luminaires without incurring excessive inventory and design costs. Also manufacturers want to take advantage of economies of scale when manufacturing. As such there is a need for a modular, easy to manufacture and install lighting fixtures and components that share common parts yet still provide beneficial solutions to the design criteria listed above.

SUMMARY

Disclosed herein is a luminaire having a hub assembly comprising the following: a socket for holding a lamp, said socket also providing one or more electrical connections to said lamp; a socket holder fixedly coupled to the socket, said socket holder having a hollow raised threaded portion extending away from the socket; a housing for enclosing the socket and the socket holder, said housing having a through a first opening for allowing the threaded portion to extend into the housing and at least one second opening to allow for one or more electrical wires such that the wires pass through the second opening and through the first opening and connect to the socket through the hollow raised portion; a spring washer and a nut for connecting the threaded portion to the housing; a stop pin slidably affixed to the socket holder and extending into the housing for limiting the rotation of the housing to a predetermined amount; a first extended member extending from a first side of the second hole, said first extended member having a threaded hole for fastening to a support member; a second extended member extending from a second side of the second hole, said second extended member having a threaded hole for fastening to the support member; and at least one hollow support member providing for one or more of the extended members to fit inside the support member aligning to the inside walls of the hollow support member, wherein the socket holder is rotatably coupled to the housing such that the socket holder is adjustable relative to the housing.

The construction and method of operation of the invention, however, together with additional objectives and advantages thereof will be best understood from the following description of specific embodiments when read in connection with the accompanying drawings.

DESCRIPTION

Figure 1:
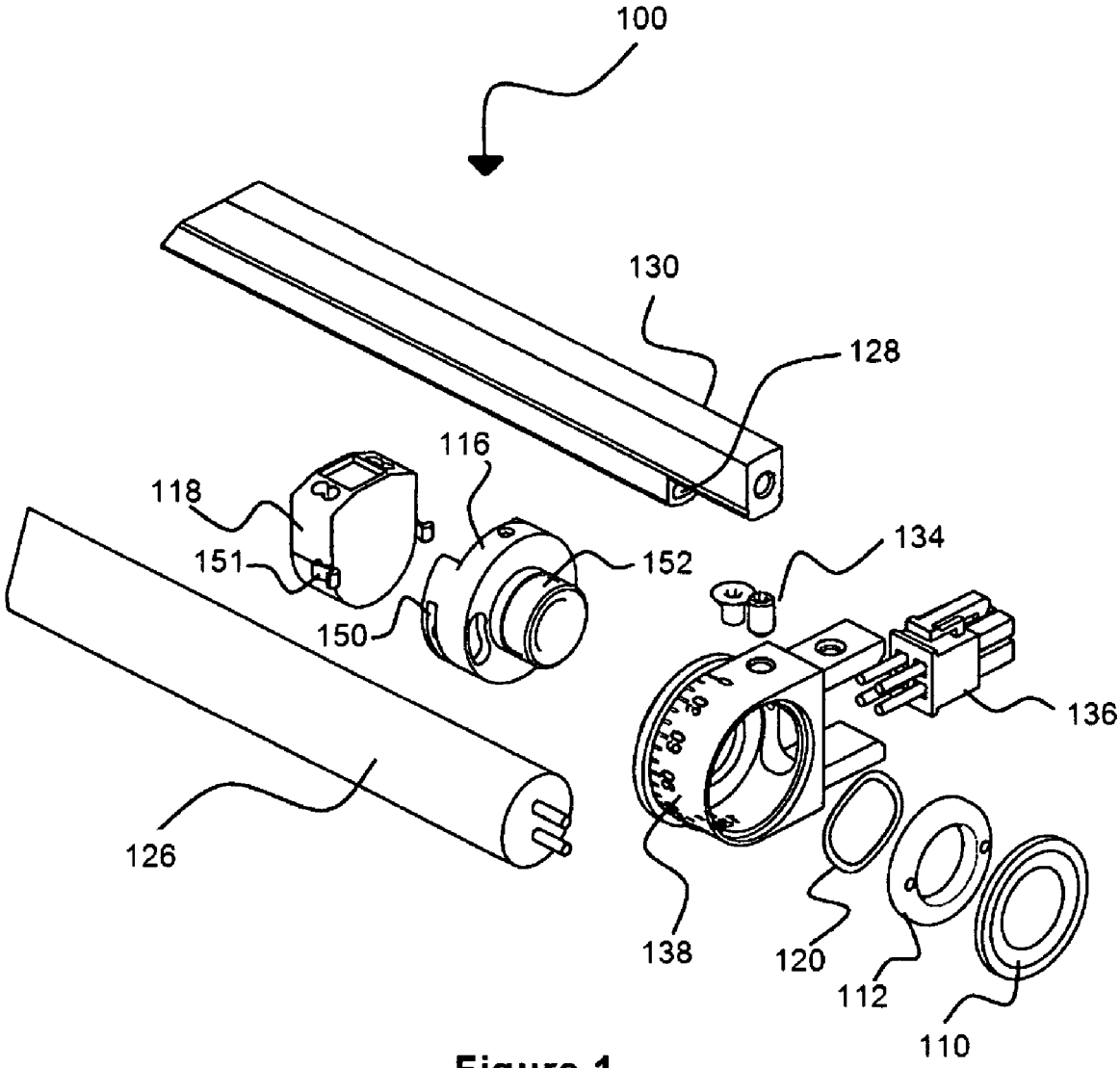
FIG. 1 shows one embodiment of a hub assembly for a luminaire according to one aspect of the current disclosure.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 shows one embodiment of a hub assembly 100 for a luminaire according to one aspect of the current disclosure. The rotatable hub 100 comprises an electrical socket 118 (such as a BJB socket #26.641.2001 or similar) for holding the lamp 126 and providing electricity to operate the lamp, a socket base 116 for holding the socket 118. In this embodiment the socket base 116 has a raised threaded portion 152 which extends into an electrical connector housing 138. The electrical connector housing 138 is mounted to the socket base 116 by a spring washer 120, a hub nut 112 and a hub cap 110. Mounting the socket base 116 using the threaded raised portion 152 allows the socket to swivel or rotate in relation to the electrical connector housing 138. Since the hub nut 112 is screwed on to the threaded portion 152, the electrical connector housing 138 is rotatably coupled to the socket base 116. The electrical connector housing 138 has indicia on it indicating the relative position of the light rail 130. Set screw 134 holds the rotatable hub 100 in place once its position is set.

In view of the foregoing, another aspect of this embodiment is that socket base 116 has mounting holes 150 (only one shown) such that the tabs 151 of lamp socket 118 can mount by snapping in place. The size of mounting holes 150 is determined by the size of the tabs 151 on the socket 118. One having skill in the art would recognize that the design of socket base 116 can be modified to accommodate differing sockets 118 and still be within the spirit of the current invention. In this embodiment light rail 130 is shown such that electrical wiring can be run down a bore 128 of the rail frame 130. This access 128 is used to provide electricity to the opposite end of the lamp 126 without exposing the wiring to the heat of the lamp while still maintaining an attractive luminaire. In operation the rail frame 130 may a rotatable hub on each end. Thus socket holder 116 provides a means for passing electricity to the lamp 126, providing structural support for the socket 118 and for holding the position of the light rail when set screw 134 is tightened. The light rails can be made from many materials that are structurally strong enough and can handle the necessary material stresses (for example, temperature, humidity, flammability . . . etc). In the embodiment shown, the light rail is manufactured from aluminum.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
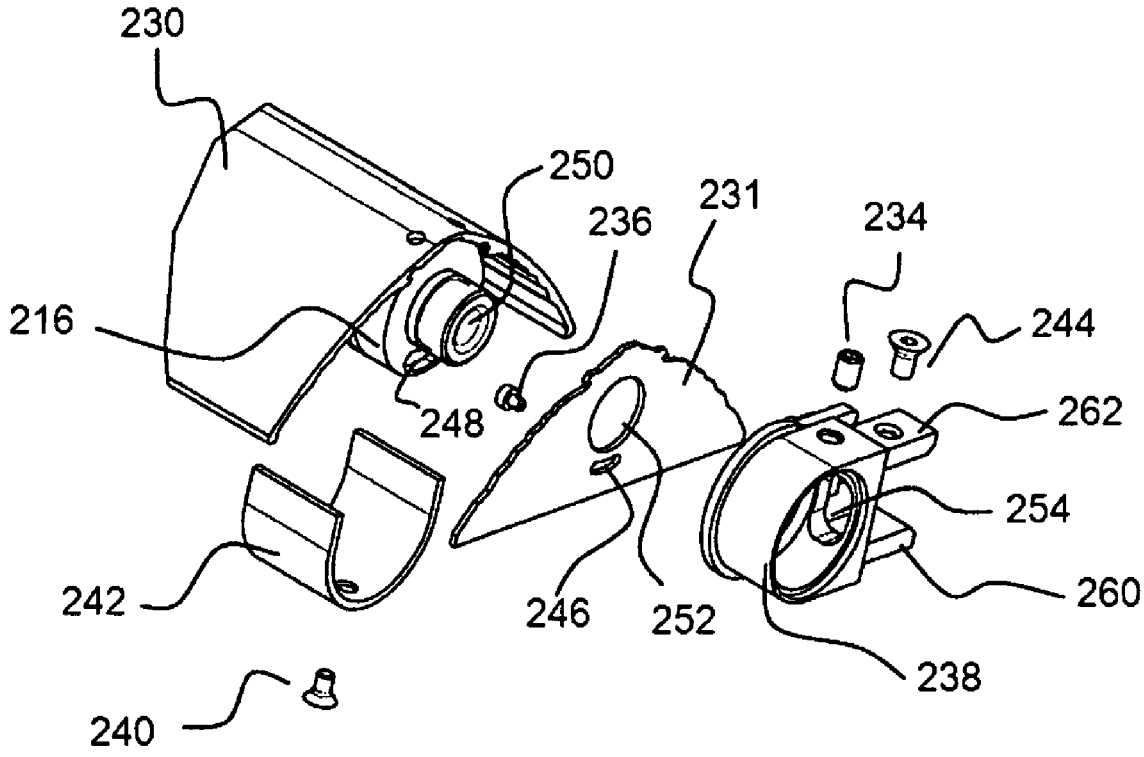
FIG. 2 shows attachment of a light rail to a rotatable hub.

FIG. 2 shows attachment of a light rail to a rotatable hub. In the figure a rotatable hub assembly is partially shown in an exploded diagram. The housing 238 is connected to a socket holder 216 by mounting hardware (not shown). The mounting hardware is screwed on to the socket holder 216 to provide support and to allow the socket holder 216 to rotate with respect to the housing 238. The rotation is limited by a stop pin 236. The stop pin has a first end disposed in slot 248 to allow a predetermined amount of play such that the stop pin is slidable. The stop pin has a second end that extends through the light rail portion 246. The housing 238 has a stop tab (not shown) that when it encounters the stop pin 236 prevents further rotation of the hub.

A light rail 230 is attached to the socket base 216 such that the light rail rotates with the socket base 216. A portion of the light rail 231 is affixed to the socket base 216 and has an elongated hole 246 for the stop pin 236 to pass through and a second hole 252 for the threaded portion of the socket base 216 to pass through. The socket holder 216 has a bore 250 to allow for passage of electrical wiring to control the lamp (not shown). The wires would extend from a lamp socket (not shown), through the bore 250 in the socket base 216 and into the cavity in the center of the housing 238. The wires would extend further outside the housing 238 through hole 254 and exit the housing. In the example shown, the light rail has an escutcheon 242 to cover the socket and socket holder 216.

In operation the rotatable hub rotates until the stop tab on the housing 238 contacts the stop pin 236. The stop pin, by having some play allows for rotation in excess of 360 degrees. The amount of rotation determined by the length of slot 248. The stop pin provides protection from rotating the rotatable hub to a point where the wiring would bunch and experience stress to the point of damaging the luminaire. In this illustration the light rail 230 can be easily changed with light rails of differing shapes. Also the design of the housing 238 provides for easy mounting to a support arm (not shown) to fix a luminaire to a ceiling, wall or other support structure.

The housing 238 has two extended members 260 and 262 for mounting to a support arm and further to a support structure such as a wall, ceiling or other fixture. The extended members reach out from the body of the housing enclosing an opening 254 for passage of electrical wires (not shown). The extended members 260 and 262 each are drilled and tapped to provide a female threaded hole for a mounting screw 244. The extended members 260 and 262 each have tapered edges to facilitate entry into a support arm. The housing 238 provides a cavity for passage of electrical wires used to power a lamp. The electrical wires may pass through the hole 254 into the cavity and further through the center bore 250 of the socket base 216. The design of the hub allows rotation of the wires when the hub is rotated and it provides for electrical wiring hidden from a user.

In the present disclosure, the housings, and hubs and other elements are manufactured from aluminum, however one skilled in the art would recognized that other materials would be suitable as long as they had the structural strength for the loads, and were of adequate fire resistance to operate the lighting system safely.

Figure 3:
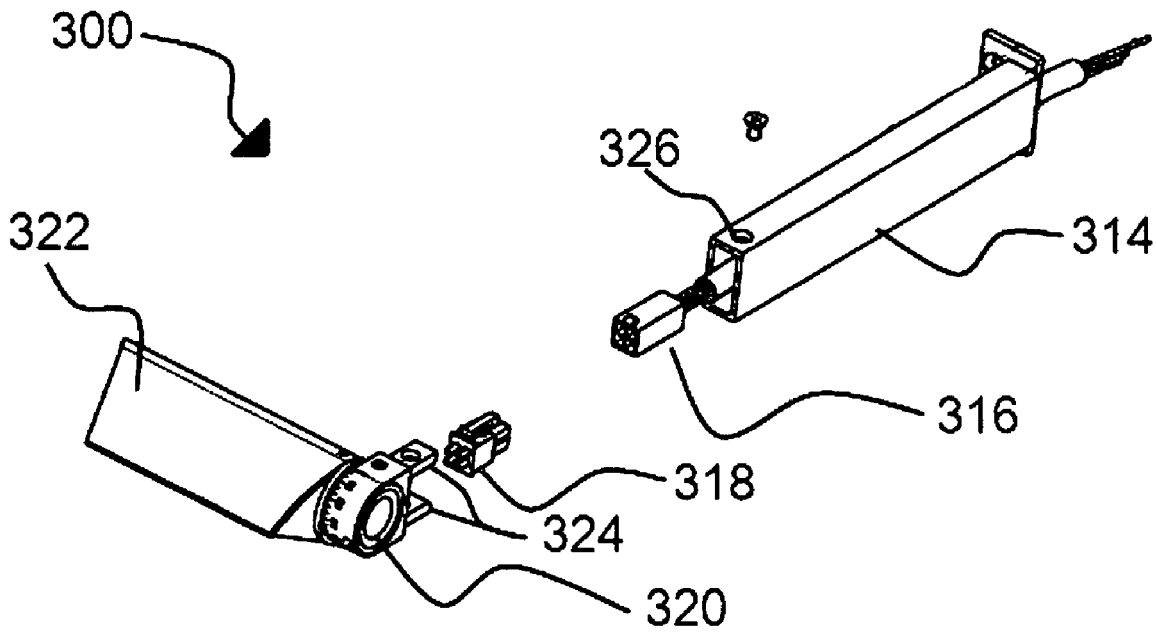
FIG. 3 shows the details of another embodiment of the present disclosure with a support arm.

FIG. 3 shows the details of another embodiment of the present disclosure with a support arm. In FIG. 3 the light assembly is shown as a light rail 322 connected to an assembled hub 320. Electricity is supplied to the lamp through wires (not shown) connected to electrical connector 318. Electrical connector 318 connects to electrical connector 316 which is connected to wires through the core of a support arm 314. In the figure the radial members 324 of the hub 320 are formed to fit firmly into a hollow core of the support arm 314 such that the radial members 324 are disposed along the interior walls of the support arm 314. Such alignment provides room for electrical wires and connectors and also causes the hub to line up with the support arm 314 thus simplifying installation. The support arm 314 provides a mounting hole 326 for screwing the support arm 314 to a radial arm 324 from the hub 320.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A hub assembly for a luminaire comprising:

a socket for holding a lamp, said socket also providing one or more electrical connections to said lamp;

a socket holder fixedly coupled to the socket, said socket holder having a hollow raised threaded portion extending away from the socket;

a housing for enclosing the socket and the socket holder, said housing having a first opening for allowing the threaded portion to extend into the housing and at least one second opening to allow for one or more electrical wires such that the wires pass through the second opening and through the first opening and connect to the socket;

a spring washer and a nut for connecting the threaded portion to the housing, wherein the socket holder is rotatably coupled to the housing such that the socket holder is adjustable relative to the housing.

2. The hub assembly of claim 1 further comprising:

a stop pin slidably affixed to the socket holder and extending to the housing for limiting the rotation of the housing to a predetermined amount, and a set screw rotatably affixed to the housing for locking the position of the socket holder relative to the housing.

3. The hub assembly of claim 1 further comprising:

at least one extended member integrally formed with the housing for providing attachment to a support member.

4. The hub assembly of claim 1 wherein the housing has an indicia for indicating the relative position of the socket and the housing.

5. The hub assembly of claim 1 further comprising:

a first extended member extending from a first side of the second hole, said first extended member having a threaded hole for fastening to a support member; and a second extended member extending from a second side of the second hole, said second extended member having a threaded through hole for fastening to the support member, wherein the first and second extended members provide for mounting the housing to a support member.

6. The hub assembly of claim 5 wherein the support member is a rectangular hollow structure providing for the first extended member and the second extended member to fit inside the support member aligning to the side walls allowing for the wires to pass into the second opening, said support member having at least one hole allowing the support member to fasten to one of the extended members.

7. The hub assembly of claim 6 wherein the wires are coupled to a connector providing easy connection and release of the wires.

8. A luminaire having a hub assembly comprising the following:

a socket for holding a lamp, said socket also providing one or more electrical connections to said lamp;

a socket holder fixedly coupled to the socket, said socket holder having a hollow raised threaded portion extending away from the socket;

a housing for enclosing the socket and the socket holder, said housing having a through a first opening for allowing the threaded portion to extend into the housing and at least one second opening to allow for one or more electrical wires such that the wires pass through the second opening and through the first opening and connect to the socket through the hollow raised portion;

a spring washer and a nut for connecting the threaded portion to the housing, a stop pin slidably affixed to the socket holder and extending into the housing for limiting the rotation of the housing to a predetermined amount;

a first extended member extending from a first side of the second hole, said first extended member having a threaded hole for fastening to a support member; and a second extended member extending from a second side of the second hole, said second extended member having a threaded hole for fastening to the support member, wherein the support member is a rectangular hollow structure providing for the first extended member and the second extended member to fit inside the support member aligning to the side walls allowing for the wires to pass into the second opening, said support member having at least one hole allowing the support member to fasten to one of the extended members, wherein the socket holder is rotatably coupled to the housing such that the socket holder is adjustable relative to the housing.

9. A luminaire having a hub assembly comprising the following:

a socket for holding a lamp, said socket also providing one or more electrical connections to said lamp;

a socket holder fixedly coupled to the socket, said socket holder having a hollow raised threaded portion extending away from the socket;

a housing for enclosing the socket and the socket holder, said housing having a through a first opening for allowing the threaded portion to extend into the housing and at least one second opening to allow for one or more electrical wires such that the wires pass through the second opening and through the first opening and connect to the socket through the hollow raised portion;

a spring washer and a nut for connecting the threaded portion to the housing;

a stop pin slidably affixed to the socket holder and extending into the housing for limiting the rotation of the housing to a predetermined amount;

a first extended member extending from a first side of the second hole, said first extended member having a threaded hole for fastening to a support member;

a second extended member extending from a second side of the second hole, said second extended member having a threaded hole for fastening to the support member; and at least one hollow support member providing for one or more of the extended members to fit inside the support member aligning to the inside walls of the hollow support member, wherein the socket holder is rotatably coupled to the housing such that the socket holder is adjustable relative to the housing.

10. An assembly for a luminaire comprising:

a socket holder having a hollow raised portion;

a housing for enclosing the socket holder, said housing having a first opening for allowing the hollow raised portion to extend into the housing and at least one second opening to allow for one or more electrical wires;

wherein the socket holder is rotatably coupled to the housing such that the socket holder is adjustable relative to the housing.

11. The assembly of claim 10 further comprising:

a socket for holding a lamp, socket providing one or more electrical connections to said lamp;

wherein the electrical connections pass through the second opening and through the first opening and connect to the socket.

12. The assembly of claim 10 further comprising:

a stop pin slidably affixed to the socket holder and extending to the housing for limiting the rotation of the housing to a predetermined amount, and a set screw rotatably affixed to the housing for locking the position of the socket holder relative to the hosuing.

13. The assembly of claim 10 wherein the hollow raised portion is threaded.

14. The assembly of claim 13 further comprising:

a spring washer and a nut for connecting the hollow raised portion to the housing.

* * * * *